US010569149B2

(12) United States Patent
Clarke

(10) Patent No.: US 10,569,149 B2
(45) Date of Patent: Feb. 25, 2020

(54) STICK HANDLING TRAINING DEVICE AND METHOD

(71) Applicant: Cable Clarke, McLean, VA (US)

(72) Inventor: Cable Clarke, McLean, VA (US)

( * ) Notice: Subject to any disclaimer, the term of this patent is extended or adjusted under 35 U.S.C. 154(b) by 0 days.

(21) Appl. No.: 15/924,660

(22) Filed: Mar. 19, 2018

(65) Prior Publication Data

US 2018/0272207 A1 Sep. 27, 2018

Related U.S. Application Data

(60) Provisional application No. 62/475,433, filed on Mar. 23, 2017.

(51) Int. Cl.

| | |
|---|---|
| ***A63B 69/00*** | (2006.01) |
| ***A63B 60/06*** | (2015.01) |
| ***A63B 69/36*** | (2006.01) |
| ***A63B 60/32*** | (2015.01) |
| ***A63B 60/20*** | (2015.01) |
| *A63B 60/00* | (2015.01) |
| *A63B 102/14* | (2015.01) |
| *A63B 102/24* | (2015.01) |
| *A63B 59/70* | (2015.01) |

(52) U.S. Cl.

CPC ..... *A63B 60/06* (2015.10); *A63B 60/20* (2015.10); *A63B 60/32* (2015.10); *A63B 69/0026* (2013.01); *A63B 69/36* (2013.01); *A63B 69/3632* (2013.01); *A63B 59/70* (2015.10); *A63B 2060/0081* (2015.10); *A63B 2102/14* (2015.10); *A63B 2102/24* (2015.10)

(58) Field of Classification Search

CPC . A63B 59/70; A63B 2102/22; A63B 2102/24; A63B 60/06; A63B 60/10; A63B 69/0008

USPC ..... 473/560–563, 568, 457, 295, 298–303; 74/551.9; 16/421, 430; D8/303

See application file for complete search history.

(56) References Cited

U.S. PATENT DOCUMENTS

| | | | | |
|---|---|---|---|---|
| 3,534,960 A * | 10/1970 | Hanks | A63B 49/08 | 473/551 |
| 3,940,134 A * | 2/1976 | Bieganowski | A63B 59/70 | 473/560 |
| 3,981,043 A * | 9/1976 | Curry | B25G 1/06 | 16/430 |
| 4,052,059 A * | 10/1977 | Rigsby | A63B 60/28 | 473/560 |
| 5,011,145 A * | 4/1991 | Bartkowicz | A63B 60/20 | 473/568 |

(Continued)

FOREIGN PATENT DOCUMENTS

| | | | |
|---|---|---|---|
| DE | 3229854 A1 * | 2/1984 | A63B 59/70 |

*Primary Examiner* — Mark S Graham

(74) *Attorney, Agent, or Firm* — The Marbury Law Group, PLLC

(57) ABSTRACT

Various embodiments include a stick handling training device for a user to hold in one hand while holding an elongate shaft of sporting equipment in another hand. The stick handling training device includes an elongate tubular body configured to cover a portion of the sporting equipment shaft. The elongate tubular body includes an outer grip surface for the user to hold in the one hand. A cylindrical passage is included through the elongate tubular body from a first aperture at a first end to a second aperture at a second end. A diameter of the cylindrical passage is larger than a widest lateral dimension of the elongate shaft such that when the elongate shaft is disposed in the cylindrical passage and the outer grip surface is held by the user, the user may freely rotate and slide the elongate tubular body relative to a longitudinal axis of the elongate shaft.

13 Claims, 7 Drawing Sheets

(56) References Cited

U.S. PATENT DOCUMENTS

| | | | | | |
|---|---|---|---|---|---|
| 5,125,130 | A * | 6/1992 | Stanish | B25G 1/102 | 16/430 |
| 5,263,711 | A * | 11/1993 | Addis | A63B 59/70 | 473/562 |
| D378,798 | S * | 4/1997 | Berti | D32/52 | |
| 5,816,961 | A * | 10/1998 | Kraemer | A63B 59/70 | 473/560 |
| 5,974,775 | A * | 11/1999 | Niehuss | A01D 7/00 | 294/58 |
| 6,248,031 | B1 * | 6/2001 | Brodie | A63B 59/70 | 473/560 |
| 6,254,498 | B1 * | 7/2001 | Tyner | A63B 69/0002 | 473/422 |
| 6,419,601 | B1 * | 7/2002 | Kenner | A63B 49/08 | 473/552 |
| 6,500,079 | B1 * | 12/2002 | Tucker, Sr. | A63B 49/08 | 473/513 |
| 6,949,036 | B2 * | 9/2005 | Ciesar | A63B 15/00 | 473/457 |
| 7,297,078 | B2 * | 11/2007 | Libonati | A63B 15/005 | 473/457 |
| 7,857,717 | B2 | 12/2010 | Martin | | |
| 8,920,256 | B1 * | 12/2014 | Ffitch | A63B 69/3632 | 473/219 |
| 2003/0144089 | A1 | 7/2003 | Ryan | | |
| 2008/0168629 | A1 * | 7/2008 | Touchette | B25D 1/14 | 16/430 |
| 2008/0318713 | A1 | 12/2008 | Beach | | |

* cited by examiner

STICK HANDLING TRAINING DEVICE AND METHOD

BACKGROUND

Players of sports that use a stick, such as ice hockey, field hockey, baseball, cricket, lacrosse, or golf, must not only know how to play their game but must also develop exquisite control over the particular type of stick used in that game. In order to improve or master stick skills, players generally train or practice for many hours. Without proper guidance, such training or practice may be ineffectual and/or lead to bad habits or strength imbalances that may not be desirable.

SUMMARY

Various embodiments provide a stick handling training device for a user to hold in one hand while holding an elongate shaft of sporting equipment in another hand. The stick handling training device may include an elongate tubular body configured to cover a portion of the elongate shaft of the sporting equipment. The elongate tubular body may include an outer grip surface and a cylindrical passage. The outer grip surface may be configured for the user to hold in the one hand. The cylindrical passage may be formed through the elongate tubular body from a first aperture at a first end of the elongate tubular body to a second aperture at a second end of the elongate tubular body. A diameter of the cylindrical passage may be sized to be larger than a widest lateral dimension of the portion of the elongate shaft such that when the portion of the elongate shaft is disposed in the cylindrical passage and the outer grip surface is held by the user, the user may freely rotate the elongate tubular body around a longitudinal axis of the elongate shaft and freely slide the elongate tubular body along the longitudinal axis.

In some embodiments, the elongate tubular body may be rigid. The outer grip surface may include a slip-resistant texture. The first end and the second end may each include a flange protruding beyond the outer grip surface radially away from the longitudinal axis of the elongate tubular body. A first axis extending perpendicular to the first aperture may be oriented at a first oblique angle relative to the longitudinal axis of the elongate tubular body. Also, a second axis extending perpendicular to the second aperture may be oriented at a second oblique angle relative to the longitudinal axis of the elongate tubular body. The first axis and the second axis may be parallel to one another. A first axis extending perpendicular to the first aperture and a second axis extending perpendicular to the second aperture may both extend at a same oblique angle relative to the longitudinal axis of the elongate tubular body. The sporting equipment may be one of an ice hockey stick, a lacrosse stick, a golf club, a field hockey stick, a baseball bat, and a cricket bat. An inner surface of the cylindrical passage may be continuously smooth from the first aperture to the second aperture for promoting the free rotation and/or sliding of the elongate shaft relative to the elongate tubular body.

Some embodiments may include a shaft adapter configured to wrap around and be secured to the portion of the sporting equipment. When the portion of the elongate shaft is disposed in the cylindrical passage, the shaft adapter may be interposed between the portion of the elongate shaft and the elongate tubular body. An outer surface of the shaft adapter may promote free rotation and/or sliding between the shaft adapter and the elongate tubular body. The shaft adapter may include two portions that separate for installation on opposed sides of the portion of the elongate shaft.

Various embodiments provide a method of using a stick handling training device. The method may include inserting at least a portion of an elongate shaft of sporting equipment through a cylindrical passage of an elongate tubular body of the stick handling training device. The cylindrical passage may extend through the elongate tubular body from a first aperture at a first end of the elongate tubular body to a second aperture at a second end of the elongate tubular body. A diameter of the cylindrical passage may be sized to be larger than a widest lateral dimension of the portion of the elongate shaft. A user may hold, with a first hand, an outer grip surface of the elongate tubular body. Also, the user may hold, with a second hand, another portion of the elongate shaft not covered by the elongate tubular body. The user may rotate and/or slide the elongate shaft held by the second hand relative to the stick handling training device held by the first hand.

In some embodiments the elongate shaft held by the second hand may rotate relative to the stick handling training device held by the first hand, while holding one of an ice hockey stick, a lacrosse stick, a golf club, a field hockey stick, a baseball bat, and a cricket bat. Also, a shaft adapter may be installed on the elongate shaft. The shaft adapter may wrap around and be secured to the portion of the sporting equipment. Thus, when the portion of the elongate shaft is disposed in the cylindrical passage, the shaft adapter may be interposed between the portion of the elongate shaft and the elongate tubular body.

BRIEF DESCRIPTION OF THE DRAWINGS

The accompanying drawings, which are incorporated herein and constitute part of this specification, illustrate exemplary embodiments of the invention, and together with the general description given above and the detailed description given below, serve to explain the features of the invention.

DETAILED DESCRIPTION

Figure 1:
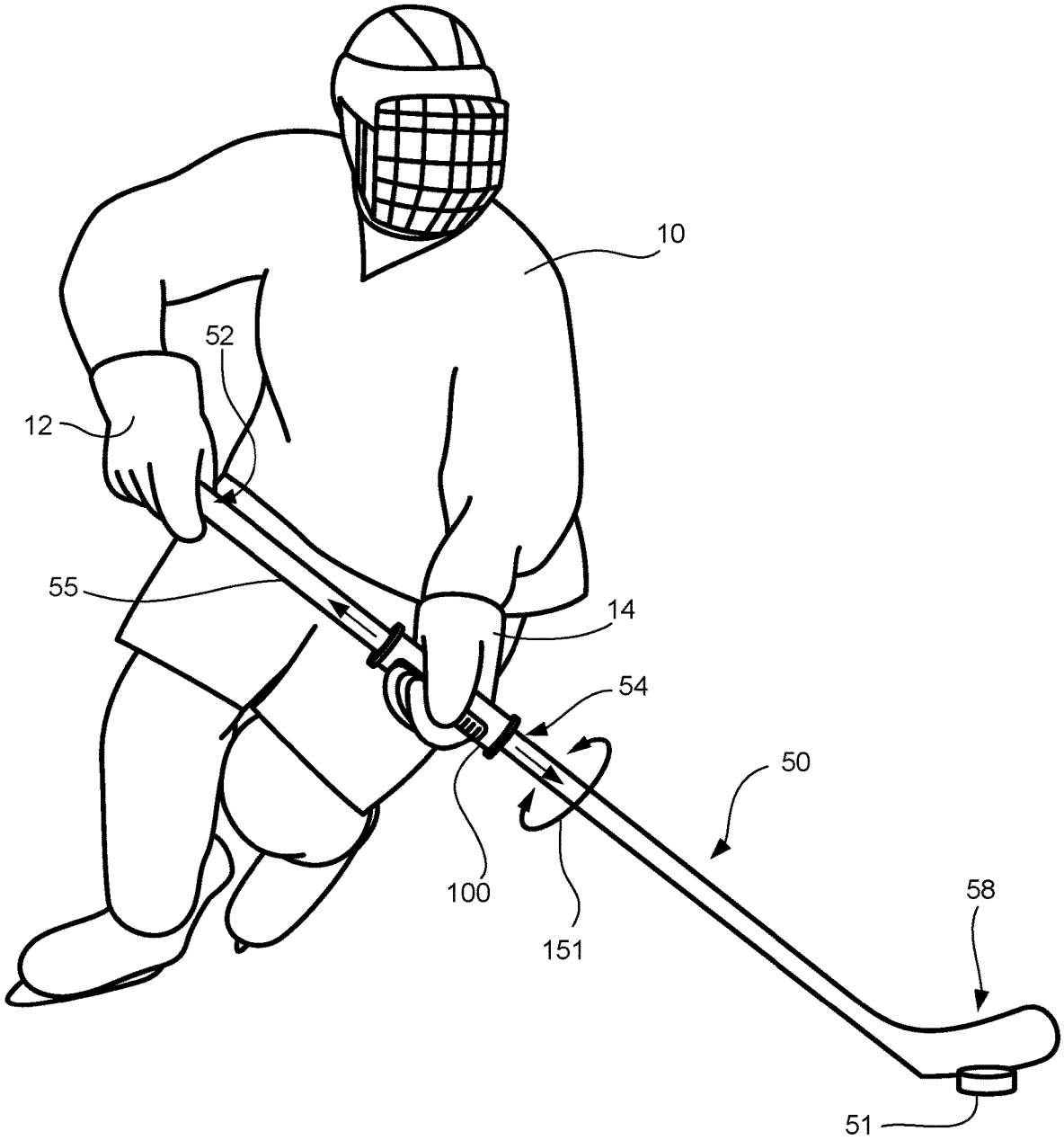
FIG. 1 illustrates an ice hockey player using a forward hand to hold a stick handling training device, positioned on an ice hockey stick, in accordance with various embodiments.

The various embodiments will be described in detail with reference to the accompanying drawings. Wherever possible, the same reference numbers will be used throughout the drawings to refer to the same or like parts. References made to particular examples and implementations are for illustrative purposes and are not intended to limit the scope of the invention or the claims.

Various embodiments provide a stick handling training device and methods of using the stick handling training device. The stick handling training device may include an elongate tubular body configured to be positioned on and cover a portion of the elongate shaft of the sporting equipment. The elongate tubular body may include an outer grip surface configured for the user to hold in one hand. Also, the elongate tubular body may include a cylindrical passage extending therethrough from a first aperture at a first end of the elongate tubular body to a second aperture at a second end of the elongate tubular body. A diameter of the cylindrical passage may be sized to be larger than a widest lateral dimension of the portion of the elongate shaft. In this way, when the portion of the elongate shaft is disposed in the cylindrical passage and the outer grip surface is held by the user, the user may freely rotate the elongate tubular body around a longitudinal axis of the elongate shaft and freely side the elongate tubular body along the longitudinal axis of the elongate shaft.

In accordance with various embodiments, the stick handling training device may be used to optimize stick handling performance and advance athletic ability in sports in which the players use two hands manipulating sporting equipment with an elongate shaft (i.e., a stick, club, bat, etc.). The stick handling training device when positioned on the elongate shaft is configured to slide and/or rotate freely relative to the elongate shaft. When a player's hand directly grips the elongate shaft of sporting equipment, that direct-gripping hand generally has control over at least part of the sporting equipment. In contrast, when the player's hand grips the stick handling training device, free to slide and/or rotate relative to the elongate shaft, the device-gripping hand may have less control over the movement of the elongate shaft. Reducing the amount of stick control one hand may exert (i.e., the device-gripping hand, which holds the stick handling training device) may force the direct-gripping hand to exert more control force, which may help develop more strength, range-of-motion, speed, finesse, and control in that direct-gripping hand.

Using the stick handling training device in accordance with various embodiments may force a direct-gripping hand to exert increased levels of control to perform stick skills, which may help develop fast-twitch muscles and enhance muscle memory in that direct-gripping hand. The stick handling training device may be used to improve either a player's dominant or non-dominant hand/wrist/arm, depending on which handholds the stick handling training device described herein. Even established players who think that they have peaked in their performance skills, may achieve significant performance gains after using the stick handling training device in accordance with various embodiments.

FIG. 1 illustrates a stick handling training device 100 being used by a user 10 in a forward position on an elongate shaft of sporting equipment 50 in the form of an ice hockey stick, in accordance with various embodiments. The user 10 may hold in a rearward hand 12 (e.g., the user's right hand) an end portion 52 of an elongate shaft 55 of the sporting equipment 50. Meanwhile, the user 10 may hold in a forward hand 14 (e.g., the user's left hand) the stick handling training device 100 in a central portion 54 of the elongate shaft 55, which position is referred to herein as the "forward position." The user 10 may switch hands from the configuration shown in FIG. 1 while still maintaining the stick handling training device in the forward position. In this way, the user's left hand may act as the rearward hand 12, which holds the end portion 52 of the elongate shaft 55, while the user's right hand becomes the forward hand 14, which holds the stick handling training device 100 positioned on the central portion 54 of the elongate shaft 55.

To use the stick handling training device 100 on an ice hockey stick, the user 10 may insert an end of the elongate shaft 55 through a cylindrical passage of an elongate tubular body of the stick handling training device 100. Alternatively, the user 10 may slide the stick handling training device 100 over the end of the elongate shaft 55. The cylindrical passage may extend through the elongate tubular body from a first aperture at a first end of the elongate tubular body to a second aperture at a second end of the elongate tubular body. An inner diameter of the cylindrical passage may be sized to be larger than a widest lateral dimension of the elongate shaft 55 of the sporting equipment 50. For an ice hockey stick the widest lateral dimension may be the diagonal dimension for the generally rectangular cross-section of the elongate shaft 55. The user may continue sliding the elongate shaft 55 through the cylindrical passage until the stick handling training device 100 reaches the forward position or other desired position.

To hold the stick handling training device 100 in the forward position on an ice hockey stick, as shown in FIG. 1, the user 10 may hold the forward hand 14 (i.e., a first hand) on an outer grip surface of the elongate tubular body. The user 10 may also then hold the rearward hand 12 (i.e., a second hand) on another portion of the elongate shaft not covered by the elongate tubular body. In particular, the user may hold the end portion 52 of the elongate shaft 55 with the rearward hand 12. Once the user 10 is holding the stick handling training device 100 firmly in the forward position, the user 10 employs the rearward hand 12 to rotate the elongate shaft 55 relative to the stick handling training device 100 held from rotating by the forward hand 14. Rotation of the elongate shaft 55 relative to the stick handling training device 100 also means the stick handling training device 100 rotates relative to the elongate shaft 55. In this way, the user 10 may rotate the elongate shaft 55 through a range of angles 151 limited mainly by a rotational range of motion of the wrist of the rearward hand 12. In addition, the elongate tubular body of the stick handling training device 100 may fit loosely on the elongate shaft 55, which allows the user 10 to freely slide the stick handling training device 100 in either direction along a longitudinal axis of the elongate shaft 55.

The user 10 may use the stick handling training device 100 to practice or play ice hockey and/or perform all the same techniques and tricks the user 10 would attempt to perform with or without the stick handling training device 100. Use of the stick handling training device 100 in the forward position may help the rearward hand 12 (i.e., the directly gripping hand) to develop better control over the remote end 58 (i.e., the hockey stick blade) of the elongate shaft 55, which may provide better accuracy in handling and shooting a puck 51. The user 10 may use the stick handling training device 100 with or without other sports equipment traditionally used in ice hockey. For example, the user 10 may or may not use gloves on the rearward hand 12 and/or the forward hand 14. Also, the user 10 may wear any other sporting equipment normally used in ice hockey.

Figure 2:
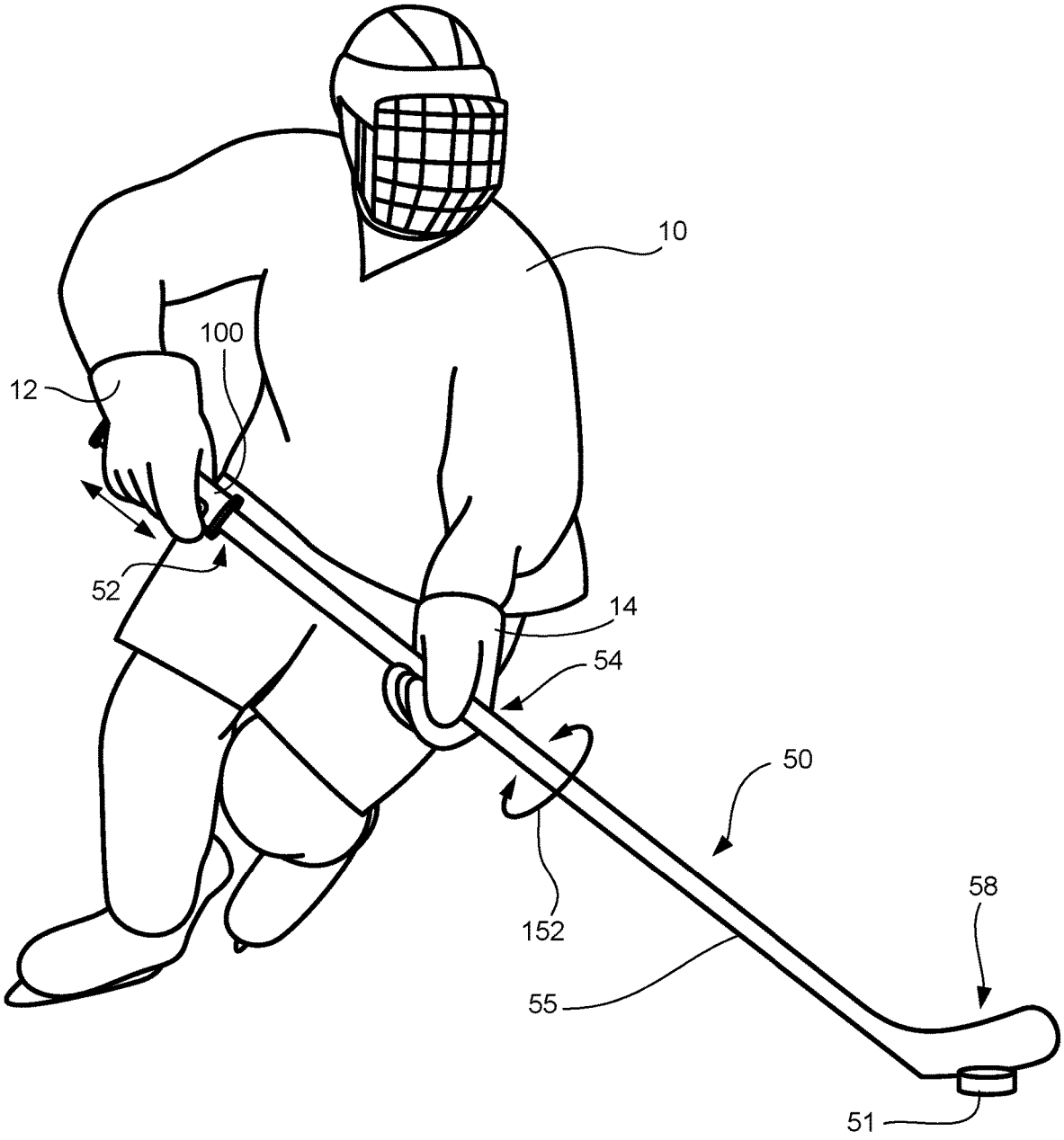
FIG. 2 illustrates an ice hockey player using a rearward hand to hold a stick handling training device, positioned on an ice hockey stick, in accordance with various embodiments.

FIG. 2 illustrates the stick handling training device 100 used by the user 10 on the same sporting equipment 50 shown in FIG. 1, but in a rearward position, in accordance with various embodiments. The user 10 may hold the stick handling training device 100 in the rearward hand 12, positioning the stick handling training device 100 so that it covers the end portion 52 of the elongate shaft 55, which position is referred to herein as the "rearward position." Meanwhile, the user 10 may directly grip the central portion 54 of the elongate shaft 55 with the forward hand 14. The user 10 may switch hands from the configuration shown in FIG. 2 while still maintaining the stick handling training device in the rearward position. In this way, the user's left hand may act as the rearward hand 12, which holds the stick handling training device 100 positioned on the end portion 52 of the elongate shaft 55, while the user's right becomes the forward hand 14, which grips the central portion 54 of the elongate shaft 55.

To hold the stick handling training device 100 in the rearward position on an ice hockey stick, as shown in FIG. 2, the user 10 may use the forward hand 14 to grip the central portion 54 of the elongate shaft 55, while the rearward hand 12 holds the outer grip surface of the stick handling training device 100. In this way, the user may hold the stick handling training device 100 firmly in the rearward position with the rearward hand 12 while the forward hand 14, gripping the central portion 54 of the elongate shaft 55, rotates the elongate shaft 55 relative to the stick handling training device 100. The user 10 may thus rotate the elongate shaft 55 through a range of angles 152 limited mainly by a rotational range of motion of the wrist of the forward hand 14. Also, the user 10 may freely slide the stick handling training device 100 in either direction along the longitudinal axis of the elongate shaft 55.

Similar to holding the stick handling training device 100 in the forward position (see FIG. 1), the user 10 may use the stick handling training device 100 to practice or play ice hockey and/or perform all the same techniques and tricks the user 10 would attempt to perform with or without the stick handling training device 100. Use of the stick handling training device 100 in the rearward position may help the forward hand 14 (i.e., the directly gripping hand) to develop better control over the remote end 58 (i.e., the hockey stick blade) of the elongate shaft 55, which may provide better accuracy in handling and shooting the puck 51. Once again, the user 10 may use the stick handling training device 100 in the rearward position with or without other sports equipment traditionally used in the sport. Also, the user 10 may use the stick handling training device 100 in the rearward position while wearing any other sporting equipment normally used in the sport.

Various embodiments are described herein with regard to using the stick handling training device 100 on an ice hockey stick. It should be understood, however, that since a field hockey stick is generally held in a similar configuration to an ice hockey stick that the descriptions herein with regard to an ice hockey stick may apply similarly to the use of the stick handling training device 100 on a field hockey stick or other similarly held sporting equipment.

Figure 3:
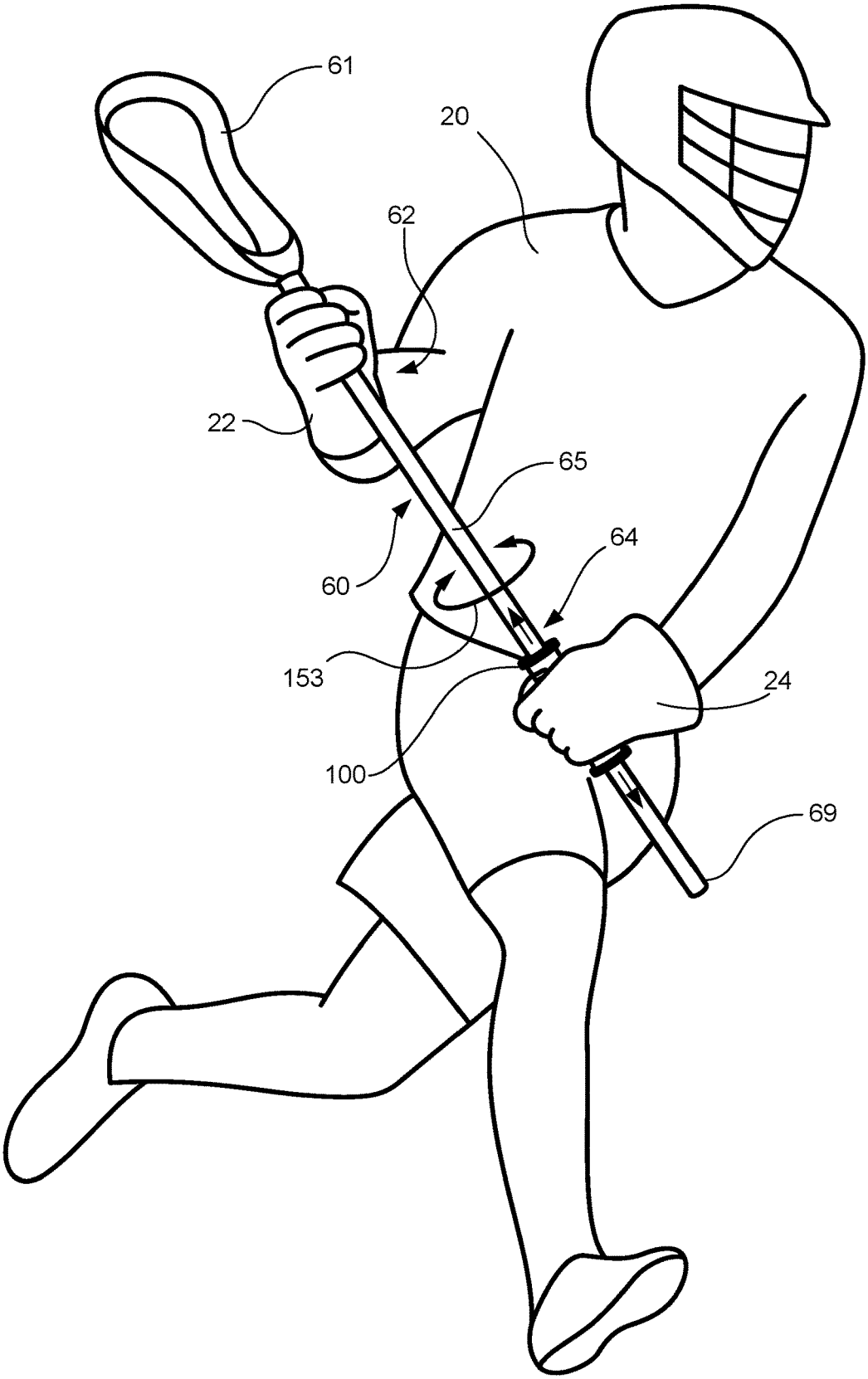
FIG. 3 illustrates a lacrosse player using a lower hand to hold a stick handling training device, positioned on a lacrosse stick, in accordance with various embodiments.

FIG. 3 illustrates the stick handling training device 100 being used by a user 20 on an elongate shaft 65 of sporting equipment 60 in the form of a lacrosse stick, in accordance with various embodiments. The user 20 may hold an upper portion 62 of the elongate shaft 65 of the sporting equipment 60 in an upper hand 22 (e.g., the user's right hand) Meanwhile, the user 10 may use a lower hand 24 (e.g., the user's left hand) to hold the stick handling training device 100 over a lower portion 64 (i.e., lower relative to the upper portion 62) of the elongate shaft 65. The user 20 may switch hands while still holding the stick handling training device 100 in the position shown in FIG. 3. In this way, the user's left hand may act as the upper hand 22, which holds the upper portion 62 of the elongate shaft 65, while the user's right hand becomes the lower hand 24, which holds the stick handling training device 100 positioned on the lower portion 64 of the elongate shaft 65.

In FIG. 3, the user 20 is holding the stick handling training device 100 in the lower hand 24, which may be referred to as a "lower position" for the stick handling training device 100. The user 20 may alternatively hold the stick handling training device 100 in the upper hand 22 (i.e., an "upper position"). However, holding the stick handling training device in the upper position may be less useful for lacrosse since players often need to allow the lower portion 64 of the elongate shaft 65 to rotate in their lower hand 24 when cradling.

To use the stick handling training device 100 on a lacrosse stick, the user 10 may insert a butt end 69 of the elongate shaft 65 through the cylindrical passage of the stick handling training device 100. Alternatively, the user 10 may slide the stick handling training device 100 over the butt end 69 of the elongate shaft 65. A diameter of the cylindrical passage may be sized to be larger than a widest lateral dimension of the elongate shaft 65. For lacrosse sticks, the widest lateral dimension may be the diagonal dimension for the cross-section of the elongate shaft 65, which is generally octagonal. The user may continue sliding the elongate shaft 65 until the stick handling training device 100 reaches the lower position or other desired position.

To hold the stick handling training device 100 in the lower position on a lacrosse stick, as shown in FIG. 3, the user 20 may hold the forward hand 24 (i.e., a first hand) on an outer grip surface of the stick handling training device 100. The user 10 may also then hold the rearward hand 22 (i.e., a second hand) on the upper portion 62 of the elongate shaft 65, near the head 61 of the lacrosse stick. Once the user 10 is holding the stick handling training device 100 firmly in the lower position, the user 10 employs the upper hand 22 to rotate the elongate shaft 55 relative to the stick handling training device 100 held from rotating by the forward hand 24. Rotation of the elongate shaft 65 is commonly done while cradling a ball in the head 61. Rotation of the elongate shaft 65 relative to the stick handling training device 100 also means the stick handling training device 100 rotates relative to the elongate shaft 65. Using the stick handling training device 100, the user 10 may rotate the elongate shaft 65 through a range of angles 153 limited mainly by a rotational range of motion of the wrist of the rearward hand 22. In addition, the elongate tubular body of the stick handling training device 100 may fit loosely on the elongate shaft 65, which allows the user 20 to freely slide the stick handling training device 100 in either direction along a longitudinal axis of the elongate shaft 65.

The user 20 may use the stick handling training device 100 to practice or play lacrosse and/or perform all the same techniques and tricks the user 10 would attempt to perform with or without the stick handling training device 100. Use of the stick handling training device 100 in the lower position may help the upper hand 22 (i.e., the directly gripping hand) to develop better control over the head 61, which may provide better accuracy in handling and shooting in lacrosse. The user 20 may use the stick handling training device 100 with or without other sports equipment traditionally used in lacrosse. For example, the user 20 may or may not use gloves on the rearward hand 12 and/or the forward hand 14. Also, the user 20 may wear any other sporting equipment normally used in lacrosse.

Various embodiments are described herein with regard to using the stick handling training device 100 on a lacrosse stick. It should be understood, however, that the descriptions herein with regard to a lacrosse stick may apply similarly to the use of the stick handling training device 100 on other similarly held sporting equipment.

Figure 4:
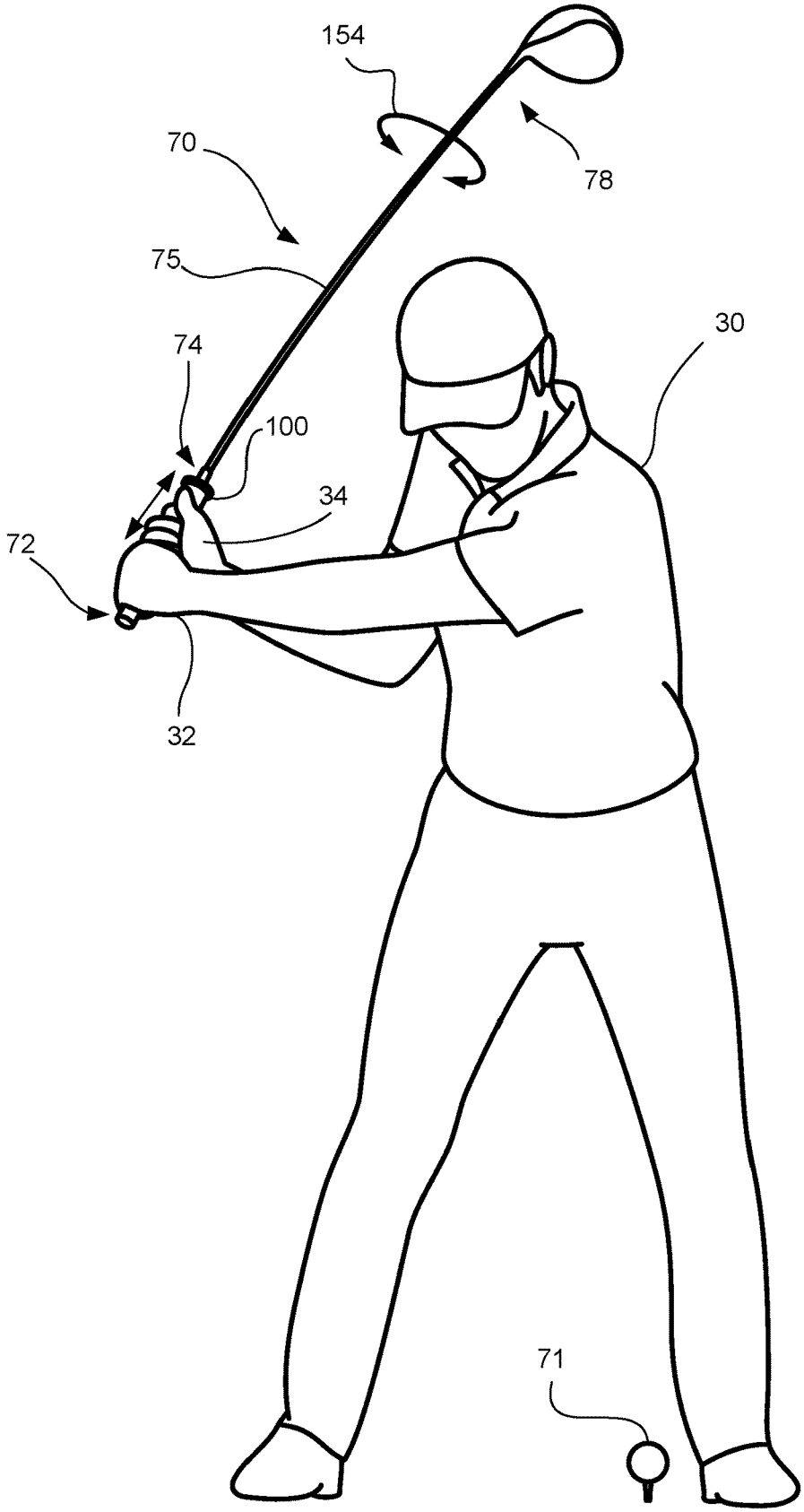
FIG. 4 illustrates a golf player using a rearward hand to hold a stick handling training device, positioned on a golf club, in accordance with various embodiments.

FIG. 4 illustrates the stick handling training device 100 being used by a user 30 on an elongate shaft 75 of sporting equipment 70 in the form of a golf club, in accordance with various embodiments. In FIG. 4, the user 30 is shown standing in a right-handers stance, which in golf typically has a left side of the user 30 facing forward (i.e., in the direction the ball is intended to travel) and a right side of the user 30 facing rearward (i.e., opposite the direction the ball is intended to travel). In the right-handers stance, the user's left hand may be considered a forward hand 32, which is placed closest to an end portion 72 of the elongate shaft 75. Also in the right-handers stance, the user's right hand may be considered a rearward hand 34, which is placed closer to a more central portion 74 of the elongate shaft 75 (at least relative to the end portion 52). Alternatively, in golf the user 30 may adopt or prefer a left-handers stance (not shown), with a right side facing forward and a left side facing rearward. In the left-handers stance, the user's right hand may be considered the forward hand 32, which is placed closest to an end portion 72 of the elongate shaft 75. Also in the left-handers stance, the user's left hand may be considered the rearward hand 34, which is placed closer to a more central portion 74 of the elongate shaft 75.

In FIG. 4, the user 30 is holding the stick handling training device 100 on a golf club in the rearward hand 34, which corresponds to the a rearward position for stick handling training device 100. For both the right-handers stance and the left-handers stance, the user 10 may hold the stick handling training device 100 in the rearward position. In the rearward position, the forward hand 32 may grip the end portion 72 of the elongate shaft 75, in the same way the user 30 normally holds the club, a few centimeters from the butt-end of the elongate shaft 75. Also, in the rearward position, the stick handling training device 100 may be held firmly by the rearward hand 34, pressed up against the forward hand 32 that is directly holding the elongate shaft 75.

Alternatively, for either the right-handers stance or the left-handers stance, the user 10 may hold the stick handling training device 100 on a golf club in a forward position (not shown). In the forward position, the forward hand 32 may hold the stick handling training device 100 over the end portion 72 of the elongate shaft 75. Also in the forward position, the rearward hand 34 may grip the more central portion 74 of the elongate shaft, up against the stick handling training device 100 being gripped by the forward hand 32.

To use the stick handling training device 100 on a golf club, the user 30 may insert the end portion 72 of the elongate shaft 75 through the cylindrical passage of the stick handling training device 100. Alternatively, the user 30 may slide the stick handling training device 100 over the end portion 72 of the elongate shaft 75. A diameter of the cylindrical passage may be sized to be larger than a widest lateral dimension of the elongate shaft 75. For a golf club, since the stick handling training device 100 is held in the handle region of a golf club, the widest lateral dimension may be the widest diameter of the golf club grip, which may have an irregular shape.

To hold the stick handling training device 100 in the rearward position on a golf club, as shown in FIG. 4, the user 30 may hold the rearward hand 34 (i.e., a first hand) on an outer grip surface of the stick handling training device 100. The user 30 may also then hold the forward hand 32 (i.e., a second hand) on the end portion 72 of the elongate shaft 75. Once the user 30 is holding the stick handling training device 100 firmly in the rearward position, the user 30 employs the forward hand 32 to rotate the elongate shaft 75 relative to the stick handling training device 100 held from rotating by the rearward hand 34. Rotation of the elongate shaft 75 relative to the stick handling training device 100 also means the stick handling training device 100 rotates relative to the elongate shaft 75. Using the stick handling training device 100, the user 30 may rotate the elongate shaft 75 through a range of angles 154 limited mainly by a rotational range of motion of the wrist of the forward hand 32. In addition, the elongate tubular body of the stick handling training device 100 may fit loosely on the elongate shaft 55, which allows the user 30 to freely slide the stick handling training device 100 in either direction along a longitudinal axis of the elongate shaft 75.

The user 30 may use the stick handling training device 100 to practice or play golf and/or perform all the same shots, techniques, and tricks the user 30 would attempt to perform with or without the stick handling training device 100. Use of the stick handling training device 100 in the rearward position may help the forward hand 32 (i.e., the directly gripping hand) to develop better control over the head 78, which may provide better accuracy in driving, putting, handling the golf club, and otherwise hitting the golf ball 71. The user 30 may use the stick handling training device 100 with or without other sports equipment traditionally used in golf. For example, the user 30 may or may not use gloves on the forward hand 32 and/or the rearward hand 34. Also, the user 20 may wear any other sporting equipment normally used in golf.

Various embodiments are described herein with regard to using the stick handling training device 100 on a golf club. It should be understood, however, that since a golf club is generally held in a similar configuration to either a baseball bat or cricket bat that the descriptions herein with regard to a golf club may apply similarly to the use of the stick handling training device 100 on a baseball bat, cricket bat, or other similarly held sporting equipment.

FIGS. 5A-5E illustrate the stick handling training device 100 in various views, including right side, top, bottom, cross-sectional, and perspective views, respectively, in accordance with various embodiments. For ease of explanation with regard to FIGS. 5A-5E, the stick handling training device 100 is described with reference to the elongate shaft 55 of the sporting equipment (e.g., 50), described above as an ice hockey stick with reference to FIGS. 1 and 2. However, it should be understood that the stick handling training device 100 may be used with other sporting equipment such as a golf club, a lacrosse stick, a field hockey stick, a baseball bat, a cricket bat, and the like.

The stick handling training device 100 may include an elongate tubular body 110 configured to cover a portion of the elongate shaft 55 of the sporting equipment. A longitudinal extent of the elongate tubular body 110 may be formed to comfortably accommodate a user's hand, including a gloved hand. In various sports, such as ice hockey or men's lacrosse, the traditional glove may be rather bulky. Thus, the stick handling training device 100 may be formed with a longer elongate tubular body 110 in order to make room for the user's glove and provide a comfortable grip. In contrast, for other sports, like golf, baseball, or women's lacrosse that do not necessarily wear a glove or optionally wear a thin glove, a shorter elongate tubular body 110 may be desirable.

The elongate tubular body 110 may be formed of a rigid material, to provide a stiff and unyielding form that more freely slides and rotates relative to the elongate shaft 55. For example, the elongate tubular body 110 may be as rigid as the elongate shaft 55. Alternatively, while the elongate tubular body 110 may be allowed to slide and/or rotate relative to the elongate shaft 55, the elongate tubular body 110 may be formed of a somewhat flexible and resilient material that may hold its shape, but yields to grip pressure. A small degree of flexibility may simply provide a more comfortable grip, but does not substantially squeeze-in on the elongate shaft 55. Alternatively, a larger degree of flexibility may allow the user to selectively resist the movement of the stick handling training device 100 relative to the elongate shaft 55 by squeezing the elongate tubular body 110 and pinching a portion thereof into contact with the elongate shaft 55. The resilient characteristic may allow the elongate tubular body 110 to regain its original form once pressure is removed.

The elongate tubular body 110 may be formed as a unitary construction (i.e., a single continuous piece) or from multiple pieces fixed together. Also, the elongate tubular body 110 may be formed as a continuous solid tubular structure (as shown in FIGS. 5A-5E). Alternatively, the elongate tubular body 110 may be formed as a spaced-mesh structure (i.e., an interlaced net-like structure), which may provide a lighter, more breathable construction. Similarly and/or additionally, the elongate tubular body 110 may include lateral apertures.

The elongate tubular body 110 may also include a cylindrical passage 120 through the elongate tubular body from a first aperture 121 at a first end 111 of the elongate tubular body 110 to a second aperture 129 at a second end 119 of the elongate tubular body 110. As illustrated in FIG. 5D, an inner diameter 125 of the cylindrical passage may be sized to be larger than a widest lateral dimension 59 of the portion of the elongate shaft 55 on which the elongate tubular body 100 is mounted. In this way, when the portion of the elongate shaft 55 is disposed in the cylindrical passage 120 and one or more of the outer grip surfaces 112, 114 is/are held by the user, rotation of the elongate shaft 55 by the user, through a range of angles 151, freely rotates the elongate shaft 55 relative to the elongate tubular body 110. Also, the user may freely slide the elongate tubular body 110 in either direction along a longitudinal axis 101 of the elongate shaft 55. Increasing the difference between the inner diameter 125 and the widest lateral dimension 59 of the intended elongate shaft 55 may encourage more relative movement (i.e., rotational or longitudinal sliding) between the stick handling training device 100 and the elongate shaft 55.

An inner surface of the cylindrical passage 120 may be continuously smooth from the first aperture 121 to the second aperture 129 for promoting the free rotation of the elongate shaft relative to the elongate tubular body. The inner surface of the cylindrical passage 120 may optionally be enhanced with a non-stick coating or material. Alternatively, the ability to rotate and/or slide relative to the elongate shaft may be impaired by providing a slightly frictional surface. Optionally, the inner surface of the cylindrical passage 120 may include relatively "soft" surfaces that protect the elongate shaft 55 from damage.

Various embodiments of the stick handling training device 100 include features configured to assist a user in properly holding or gripping the stick handling training device 100. For example, the stick handling training device 100 may include one or more outer grip surfaces 112, 114; first and second flanges 131, 139 on opposed ends; and first and second oblique angles A1, A2 on the opposed ends.

The one or more outer grip surfaces 112, 114 may be configured for the user to hold in the one hand. The outer grip surfaces may include an add-on slip-resistant textured material, such as rubber, to provide the user a more ergonomic grip. Alternatively, the outer grip surfaces 112, 114 may be formed as a rough, ribbed, or other increased frictional surface formed directly into the material forming the elongate tubular body 110. While the elongate tubular body 110 is illustrated as have two separate spaced apart outer grip surfaces 112, 114, additional outer grip surfaces may be provided. Alternatively, the outer grip surfaces may be formed from a single continuous are intended for the user to grip. In addition, while the elongate tubular body 110 and the outer grip surfaces 112, 114 are illustrated as having a straight cylindrical form, the outer surfaces of the elongate tubular body 110 may include contours or a non-linear form.

To further assist the user in keeping a hand on the stick handling training device 100, a first end 111 and a second end 119 of the elongate tubular body 110 may each include the first flange 131 and the second flange 139, respectively. The first and second flanges 131, 139 may each protrude beyond the outer grip surfaces 112, 114 radially away from the longitudinal axis 101 of the elongate tubular body 110.

To further assist the user in keeping a hand properly positioned on the stick handling training device 100, the first end 111 of the elongate tubular body 110 may include a first oblique angle A1 and/or the second end 119 of the elongate tubular body 110 may include a second oblique angle A2. The first and second oblique angles A1, A2 are formed by extended gripping surfaces on one side of one end of the stick handling training device relative to the opposite side of the same end of the stick handling training device. Such extended gripping surfaces better accommodate a user's hand, since when gripping the stick handling training device 100, the users thumb naturally grips less grip surface than the combined grip area of the opposed fingers. Also, when gripping the stick handling training device 100, the thumb is generally positioned closer to one end of the stick handling training device. When using the stick handling training device 100, the user may wrap the thumb around the device, closer to one end, and on the side having less grip surface. Meanwhile, the user's opposed fingers may wrap around the opposite side of the same end having more grip surface. In this way, the user's hand may stay better engaged with one of the first and second flanges 131, 139, which may prevent the hand from sliding off. This may also helps avoid the user's hand being pinched between the elongate shaft 55 and an edge of one of the first and second apertures 121, 129. What is more, when using the stick handling training device 100, users may unintentionally cheat by allowing one or more fingers to slip off one end of the stick handling training device 100, thus engaging the elongate shaft 55 directly. The extended grip surfaces formed by the first and second oblique angles A1, A2 may help deter such cheating by the user, by preventing the hand from falling off the stick handling training device 100.

The first oblique angle A1 may be formed between a first axis 141 extending perpendicular to the first aperture 121 and a longitudinal axis 101 of the elongate tubular body 110. Similarly, the second oblique angle A2 may be formed between a second axis 149 extending perpendicular to the second aperture 129 and the longitudinal axis 101 of the elongate tubular body 110. The first oblique angle A1 may be the equal to the second oblique angle A2. Various embodiments form the first axis 141 and the second axis 149 parallel to one another. Alternatively, the first axis 141 and the second axis 149 may be orthogonal to one another, which may form an even bigger contrast between the surface area of one longitudinal side of the stick handling training device as compared to the opposed longitudinal side. As a further alternative, only one end of the stick handling training device 100 may include an oblique angle. In this way, the end that does not include the oblique angle may have an aperture with an axis parallel to the longitudinal axis 101.

Figure 5A:
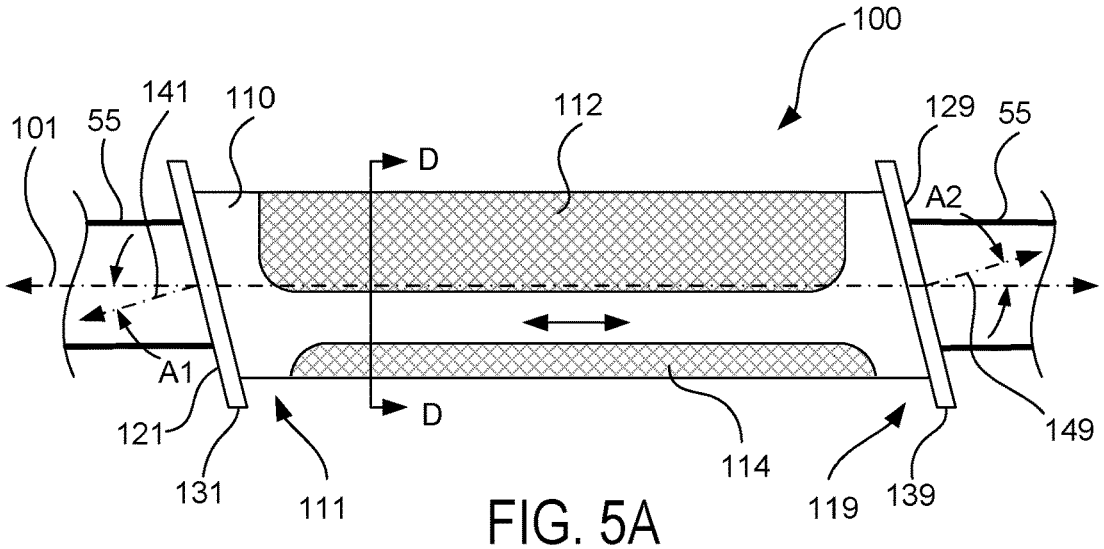
FIG. 5A illustrates a side view of a stick handling training device in accordance with various embodiments.
Figure 5B:
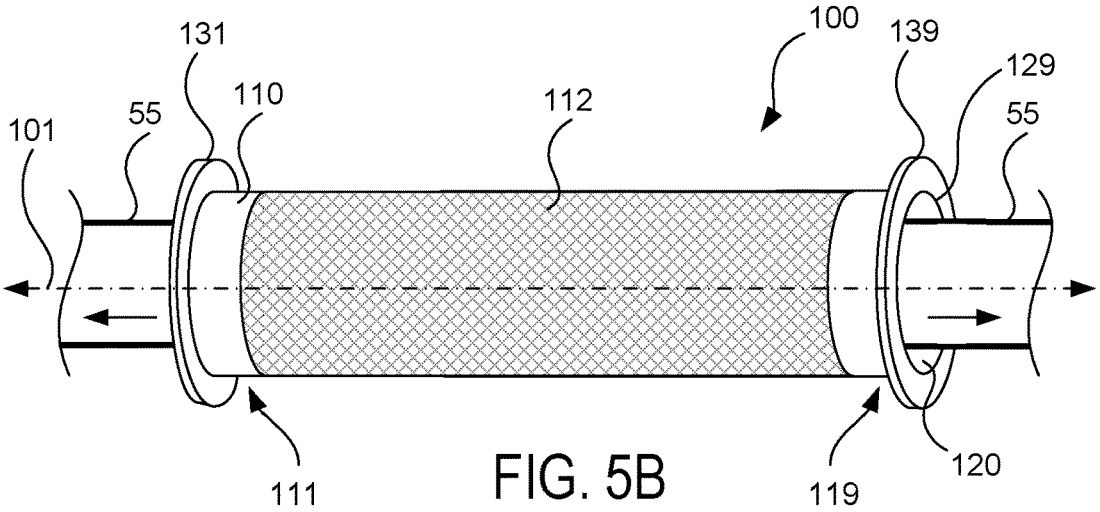
FIG. 5B illustrates a top view of the stick handling training device of FIG. 5A, in accordance with various embodiments.
Figure 5C:
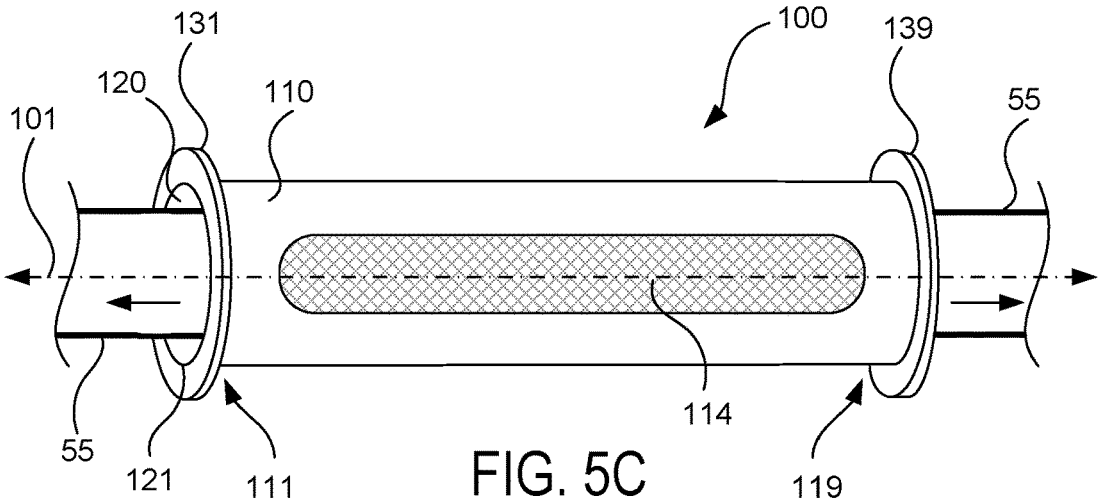
FIG. 5C illustrates a bottom view of the stick handling training device of FIGS. 5A and 5B, in accordance with various embodiments.
Figure 5D:
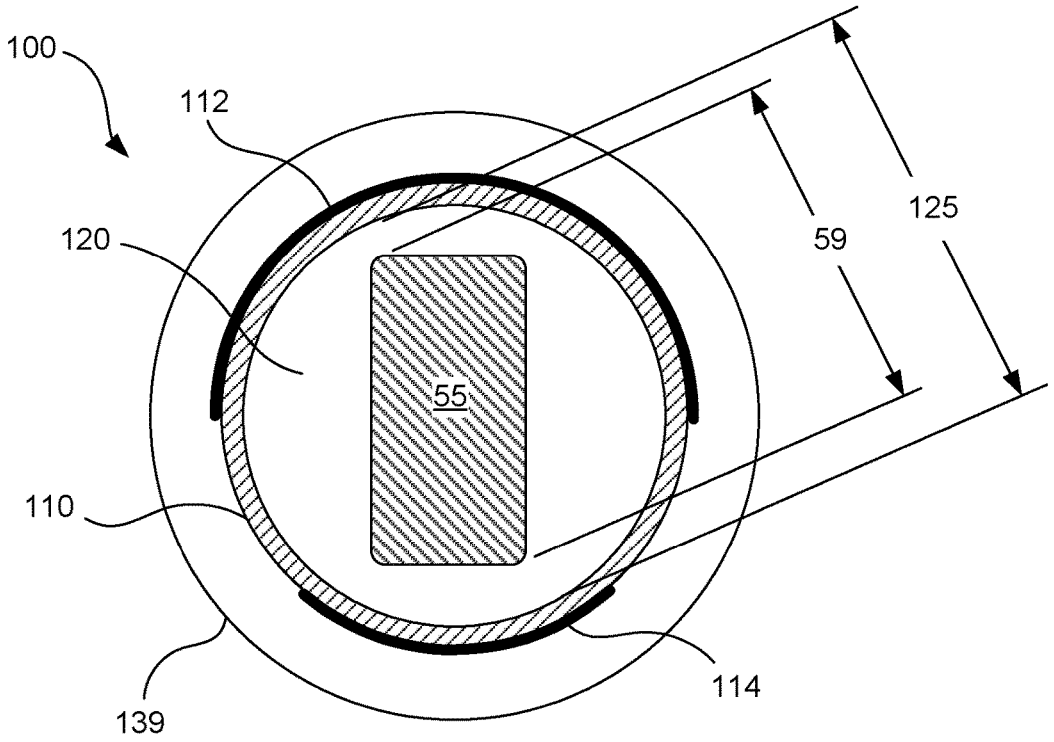
FIG. 5D illustrates a cross-sectional view of the stick handling training device of FIG. 5A at D-D, in accordance with various embodiments.
Figure 5E:
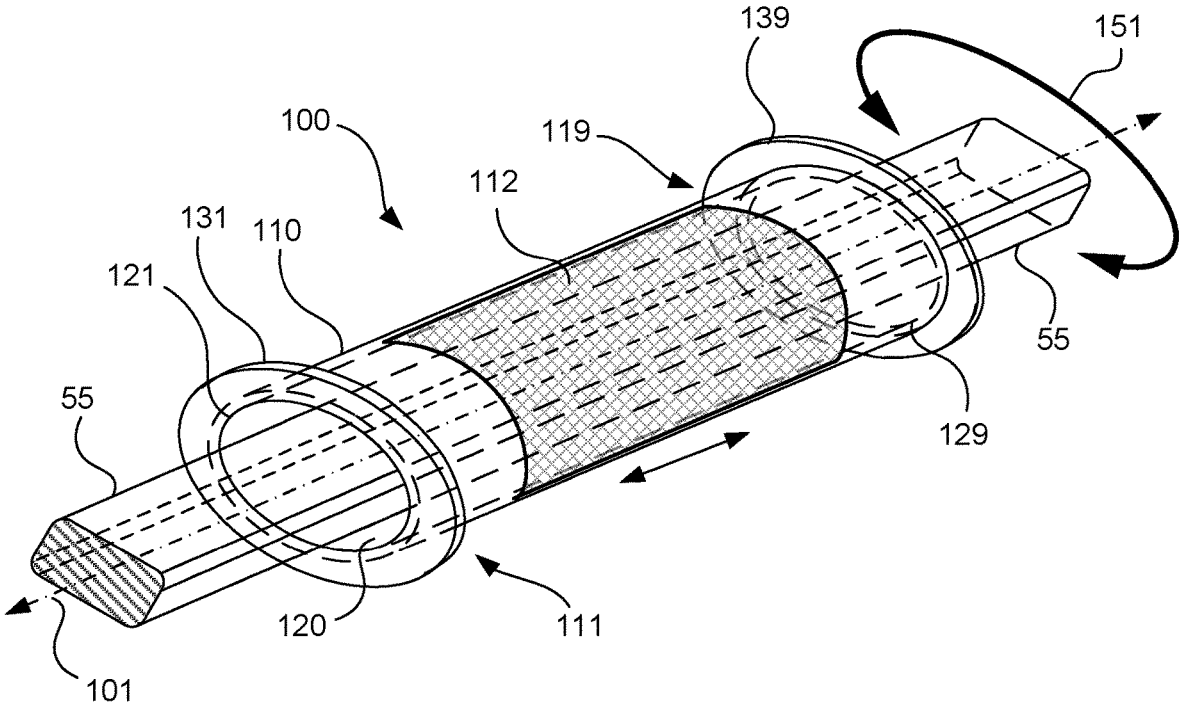
FIG. 5E illustrates a perspective view of the stick handling training device of FIGS. 5A-5D, in accordance with various embodiments.

The first and second oblique angles A1, A2 may be formed by having one side of one end of the stick handling training device 100 (e.g., the upper left side of the first end 111, in the orientation shown in FIG. 5A) to extend further along the longitudinal axis 101 of the elongate tubular body 110 than the other side of that same end (e.g., the lower left side of the first end 111, in the orientation shown in FIG. 5A). In this way, one side of one end of the stick handling training device 100 may accommodate more of the user's hand than the opposed side of that same end.

Figure 6:
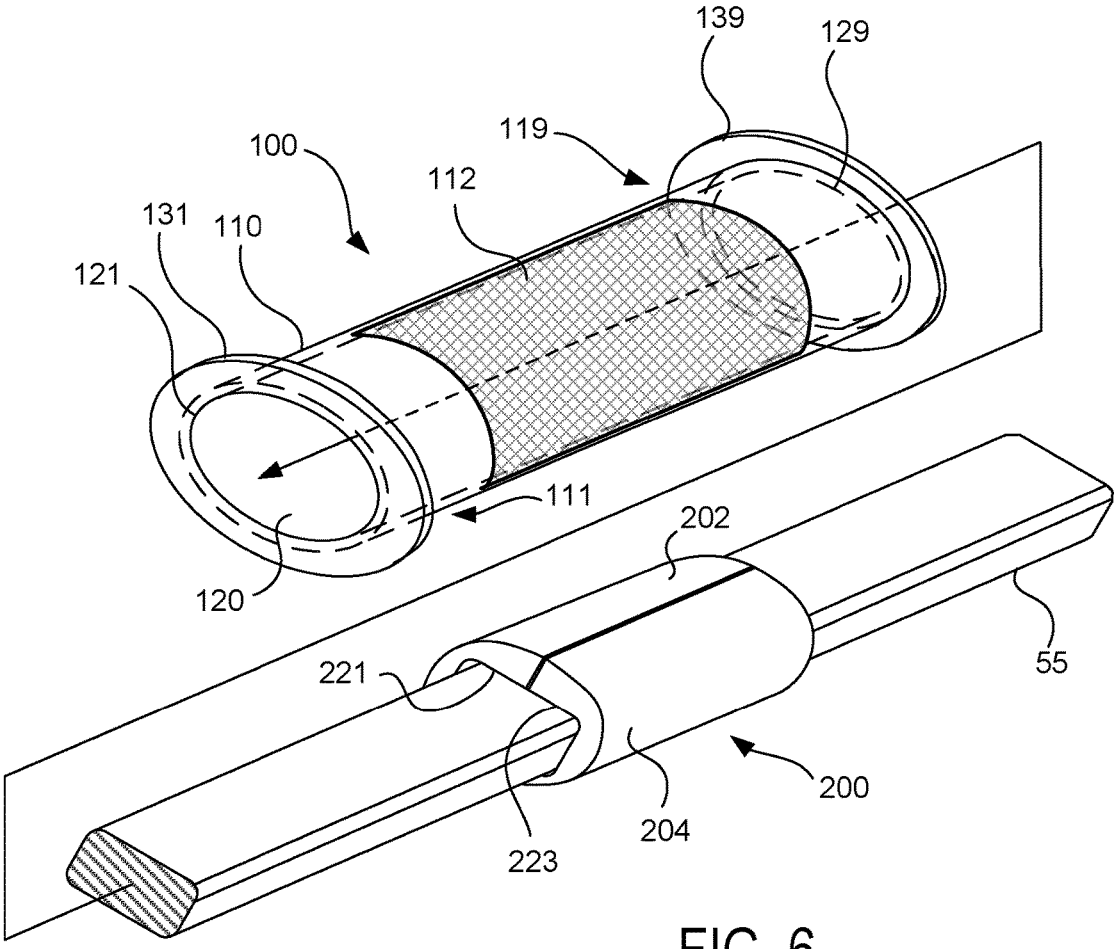
FIG. 6 illustrates a semi-exploded perspective view of a stick handling training device used with a shaft adapter in accordance with various embodiments.

FIG. 6 illustrates a semi-exploded perspective view of the stick handling training device 100 used with a shaft adapter 200 in accordance with various embodiments. The shaft adapter 200 may be configured to wrap around and be secured to the elongate shaft 55 of the sporting equipment. Thus, when the elongate shaft 55 is disposed in the cylindrical passage 120, the shaft adapter 200 may be interposed between the elongate shaft 55 and the elongate tubular body 110.

An outer surface of the shaft adapter 200 may be smooth and thus configured to promote free rotation and/or longitudinal sliding between the shaft adapter 200 and the elongate tubular body 110. In addition, the outer surface of the shaft adapter 200 may have a cylindrical shape, which may rotate within the cylindrical passage 120 more smoothly than the non-cylindrical shape of the elongate shaft 55. Further, the shaft adapter 200 may protect the elongate shaft 55 from the scraping or rubbing the stick handling training device 100 otherwise caused by the relative sliding and/or rotational movement.

The shaft adapter 200 may be formed with two segments 202, 204 that separate for installation on opposed sides of the portion of the elongate shaft 55 or a single element that wraps around the elongate shaft 55. Alternatively, the shaft adapter 200 may be formed by more than two segments. The two segments 202, 204 may have inner cavities 221, 223 shaped to conform to the outer shape of the elongate shaft 55. The two segments 202, 204 may be completely separate elements. Alternatively, the two segments 202, 204 may be pivotally or otherwise secured to one another. The two segments 202, 204 may each be formed of a rigid material, such as a hard plastic or metal. Alternatively, the two segments 202, 204 may be formed of semi-rigid or soft materials, such as foam rubber, fabric, or soft plastics. Also, the two segments 202, 204 may each be formed as a solid unitary material or alternatively formed of more than one material. For example, an outer shell of the two segments 202, 204 may be formed with a hard plastic, while an inner core is either hollow or filled with a different material, like a solid foam and/or gel. Alternatively, an outer shell of the two segments 202, 204 may be formed by a yielding material, supported by a firmer inner material.

As a further alternative, the shaft adapter 200 may be formed from a web material, like athletic tape, that wraps around the elongate shaft 55 one or more times until the desired maximum width is achieved.

To use the stick handling training device 100 with the shaft adapter 200 on the elongate shaft 55, the user may initially install the shaft adapter 200 on the elongate shaft 55 in the forward position or other desired position intended for the stick handling training device 100 to be used. In this way, the shaft adapter 200 wraps around and is secured to (i.e., mounted on) the elongate shaft 55. The user may then insert an end of the elongate shaft 55, with the shaft adapter 200 positioned thereon, through the cylindrical passage 120 of the elongate tubular body 110 of the stick handling training device 100. The user may continue sliding the elongate shaft 55 through the cylindrical passage until the shaft adapter 200 is covered by the stick handling training device 100. Alternatively, the user 10 may slide the stick handling training device 100 over the end of the elongate shaft 55 until the stick handling training device covers the shaft adapter 200.

Figure 7:
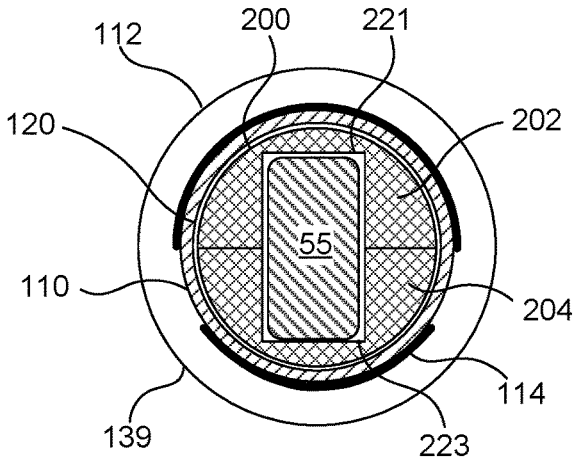
FIG. 7 illustrates an assembled cross-sectional view of the stick handling training device, shaft adapter, and elongate shaft of FIG. 6, in accordance with various embodiments.

FIG. 7 illustrates an assembled cross-sectional view of the stick handling training device, shaft adapter, and elongate shaft of FIG. 6, in accordance with various embodiments. When the shaft adapter 200 positioned on the elongate shaft 55 is disposed in the cylindrical passage 120, the shaft adapter 200 may be interposed between the elongate shaft 55 and the elongate tubular body 110. An inner diameter (e.g., 125) of the cylindrical passage 120 may be sized to be larger than an outer diameter of the shaft adapter 200. Increasing the difference between the inner diameter and the outer diameter of the shaft adapter 200 may encourage more relative movement between the stick handling training device 100 and the elongate shaft 55.

Figure 8:
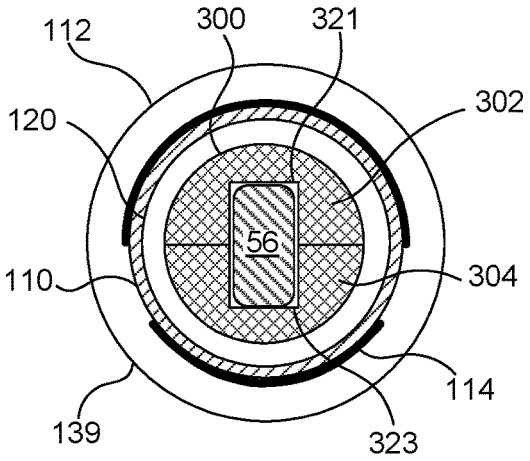
FIG. 8 illustrates an assembled cross-sectional view of a stick handling training device used with a shaft adapter on an elongate shaft, in accordance with various embodiments.

FIG. 8 illustrates an assembled cross-sectional view of a stick handling training device 100 used with a proportionally smaller shaft adapter 300 on an elongate shaft 56, in accordance with various embodiments. An outer diameter of the shaft adapter 300 may be sized to be substantially smaller than the inner diameter (e.g., 125) of the cylindrical passage 120. However, since the size of the elongate shaft 56 may limit how small the outer diameter of the shaft adapter 300 may be, the inner diameter of the elongate tubular body 110 may also be increased. In this way, the size of both the inner diameter of the elongate tubular body 110 and the outer diameter of the shaft adapter 300 may be coordinated and configured to provide the appropriate level of relative movement between those structures.

The shaft adapter 300 may otherwise be similar to shaft adapter 200. In this way, shaft adapter 300 may be formed as a single unitary member or by at least two segments 302, 304 that separate for installation on opposed sides of the portion of the elongate shaft 55. The two segments 302, 304 may have inner cavities 321, 323 shaped to conform to the outer shape of the elongate shaft 55.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the scope of the invention. Thus, the present invention is not intended to be limited to the embodiments shown herein but is to be accorded the widest scope consistent with the following claims and the principles and novel features disclosed herein.

What is claimed is:

1. A stick handling training device for a user to hold in one hand while holding an elongate shaft of sporting equipment in another hand, the stick handling training device comprising:

an elongate rectangular cross-section shaft of sporting equipment;

an elongate tubular body configured to cover a rectangular portion of the elongate shaft of the sporting equipment, wherein the rectangular portion includes the rectangular cross-section of the elongate shaft, wherein the elongate tubular body comprises:

an outer grip surface configured for the user to hold in the one hand; and a cylindrical passage through the elongate tubular body from a first aperture at a first end of the elongate tubular body to a second aperture at a second end of the elongate tubular body, wherein a diameter of the cylindrical passage is sized to be larger than a widest lateral dimension of the rectangular portion of the elongate shaft such that when the rectangular portion of the elongate shaft is disposed in the cylindrical passage and the outer grip surface is held by the user, the user may:

freely rotate the elongate tubular body around a longitudinal axis of the rectangular portion of the elongate shaft; and freely slide the elongate tubular body along the longitudinal axis of the rectangular portion of the elongate shaft, including off an end of the elongate shaft to remove the elongate tubular body from the sporting equipment.

2. The stick handling training device of claim 1, wherein the elongate tubular body is rigid.

3. The stick handling training device of claim 1, wherein the outer grip surface includes a slip-resistant texture.

4. The stick handling training device of claim 1, wherein the first end and the second end each include a flange protruding beyond the outer grip surface radially away from the longitudinal axis of the elongate tubular body.

5. The stick handling training device of claim 1, wherein a first axis extending perpendicular to the first aperture is oriented at a first oblique angle relative to the longitudinal axis of the elongate tubular body.

6. The stick handling training device of claim 5, wherein a second axis extending perpendicular to the second aperture is oriented at a second oblique angle relative to the longitudinal axis of the elongate tubular body.

7. The stick handling training device of claim 6, wherein the first axis and the second axis are parallel to one another.

8. The stick handling training device of claim 1, wherein a first axis extending perpendicular to the first aperture and a second axis extending perpendicular to the second aperture both extend at a same oblique angle relative to the longitudinal axis of the elongate tubular body.

9. The stick handling training device of claim 1, wherein the sporting equipment is an ice hockey stick.

10. The stick handling training device of claim 1, wherein an inner surface of the cylindrical passage is continuously smooth from the first aperture to the second aperture for promoting the free rotation and sliding of the rectangular portion of the elongate shaft relative to the elongate tubular body.

11. The stick handling training device of claim 1, wherein an inner surface of the cylindrical passage includes a non-stick coating for promoting the free rotation and sliding of the rectangular portion of the elongate shaft relative to the elongate tubular body.

12. A method of using a stick handling training device, the method comprising:

inserting an end of an elongate shaft of sporting equipment through a cylindrical passage of an elongate tubular body of the stick handling training device to mount the elongate tubular body on a rectangular portion of the elongate shaft, wherein the rectangular portion includes a rectangular cross-section of the elongate shaft, wherein the cylindrical passage extends through the elongate tubular body from a first aperture at a first end of the elongate tubular body to a second aperture at a second end of the elongate tubular body, wherein a diameter of the cylindrical passage is sized to be larger than a widest lateral dimension of the rectangular portion of the elongate shaft, holding, by a user with a first hand, an outer grip surface of the elongate tubular body;

holding, by the user with a second hand, another portion of the elongate shaft not covered by the elongate tubular body;

rotating the elongate shaft held by the second hand relative to the stick handling training device held by the first hand; and freely sliding the stick handling training device along the rectangular portion of the elongate shaft, including off an end of the elongate shaft to remove the stick handling training device from the sporting equipment.

13. The method of claim 12, wherein rotating the elongate shaft held by the second hand relative to the stick handling training device held by the first hand is performed while holding an ice hockey stick.

* * * * *